US009291391B2

(12) United States Patent
Hogan

(10) Patent No.: US 9,291,391 B2
(45) Date of Patent: Mar. 22, 2016

(54) METHODS FOR DRYING MATERIALS AND INDUCING CONTROLLED PHASE CHANGES IN SUBSTANCES

(71) Applicant: Flash Rockwell Technologies, LLC, Bountiful, UT (US)

(72) Inventor: John Hogan, Bountiful, UT (US)

(73) Assignee: Flash Rockwell Technologies, LLC, Bountiful, UT (US)

( * ) Notice: Subject to any disclaimer, the term of this patent is extended or adjusted under 35 U.S.C. 154(b) by 159 days.

(21) Appl. No.: 14/256,111

(22) Filed: Apr. 18, 2014

(65) Prior Publication Data

US 2014/0223762 A1 Aug. 14, 2014

Related U.S. Application Data

(63) Continuation of application No. 13/285,224, filed on Oct. 31, 2011, now Pat. No. 8,726,532.

(60) Provisional application No. 61/408,673, filed on Nov. 1, 2010, provisional application No. 61/522,922, filed on Aug. 12, 2011.

(51) Int. Cl.

| | |
|---|---|
| ***F26B 9/00*** | (2006.01) |
| ***F26B 5/00*** | (2006.01) |
| ***F26B 17/10*** | (2006.01) |

(52) U.S. Cl.

CPC ..... *F26B 5/00* (2013.01); *F26B 17/103* (2013.01); *F26B 17/104* (2013.01); *F26B 17/106* (2013.01); *F26B 17/107* (2013.01); *F26B 2200/18* (2013.01)

(58) Field of Classification Search

CPC ..... F26B 5/00; F26B 7/00; F26B 9/00; B01J 8/00; B01F 5/00; B01F 5/04; F04D 29/00; F04D 29/68; B65G 3/00; B65G 3/08; B65G 3/34

USPC ..... 34/380, 381, 402; 406/108; 159/4.06, 159/4.07; 244/198

See application file for complete search history.

(56) References Cited

U.S. PATENT DOCUMENTS

| | | | |
|---|---|---|---|
| 2,054,441 | A | 9/1936 | Peebles |
| 2,615,906 | A | 10/1952 | Stanton |

(Continued)

FOREIGN PATENT DOCUMENTS

| | | |
|---|---|---|
| DE | 1 037 374 | 8/1958 |
| FR | 1 017 406 | 12/1952 |

(Continued)

OTHER PUBLICATIONS

International Search Report—PCT/US2011/058759, Nov. 1, 2011, Flash Rockwell Technologies, LLC.

(Continued)

*Primary Examiner* — Stephen M Gravini

(74) *Attorney, Agent, or Firm* — Womble Carlyle Sandridge & Rice LLP

(57) ABSTRACT

Methods and systems are disclosed for drying a material or, more generally, flash evaporating a target substance having a vapor pressure threshold. The methods and systems include a conveyor conduit that receives material and within which a pressure is established that is greater than the vapor pressure threshold of the target substance. The material moves through the conveyor and is expelled into a pressure drop zone created by one or more venturi nozzles. The pressure in the pressure drop zone is far less than the vapor pressure threshold of the target substance. As the material encounters the pressure drop zone, the targeted substance in the material experiences a rapid and extreme pressure drop and simultaneously a rapid temperature increase. This causes the target substance in the material to flash evaporate virtually immediately. The resulting vapor is separated from the remaining material and the now dry material is collected for further processing or use. The vapor can be collected, condensed, exhausted, or otherwise treated depending upon the goals of a particular installation or process. The methods and systems are particularly useful for drying water from moisture laden material such as coal wash fines.

26 Claims, 12 Drawing Sheets

(56) References Cited

U.S. PATENT DOCUMENTS

| | | | | |
|---|---|---|---|---|
| 2,695,265 | A | 11/1954 | Degnen | |
| 3,456,357 | A | 7/1969 | Griffith | |
| 4,377,066 | A | 3/1983 | Dickinson | |
| 5,718,539 | A | 2/1998 | Segota | |
| 5,863,155 | A | 1/1999 | Segota | |
| 5,882,381 | A | 3/1999 | Hauck et al. | |
| 6,155,751 | A | 12/2000 | Lane et al. | |
| 7,048,505 | B2 | 5/2006 | Segota et al. | |
| 7,278,825 | B2 | 10/2007 | Segota et al. | |
| 7,296,411 | B2 | 11/2007 | Segota et al. | |
| 7,475,853 | B2 | 1/2009 | Segota et al. | |
| 8,052,763 | B2 | 11/2011 | Gallot | |
| 8,726,532 | B2 * | 5/2014 | Hogan | F26B 17/103 15/345 |
| 8,869,420 | B1 * | 10/2014 | Nazhad | F26B 21/08 110/342 |
| 2003/0102038 | A1 | 6/2003 | Lane et al. | |
| 2003/0188740 | A1 * | 10/2003 | Tribelsky | C02F 9/00 128/200.14 |
| 2005/0000108 | A1 | 1/2005 | Ragnarsson | |
| 2009/0277039 | A1 * | 11/2009 | Rooksby | F26B 17/101 34/367 |
| 2011/0283705 | A1 * | 11/2011 | Oliver | F42D 3/00 60/698 |
| 2012/0131813 | A1 * | 5/2012 | Hogan | F26B 17/103 34/403 |
| 2014/0048719 | A1 | 2/2014 | Johnson et al. | |
| 2014/0215842 | A1 * | 8/2014 | Hogan | F26B 21/004 34/218 |
| 2014/0223762 | A1 * | 8/2014 | Hogan | F26B 17/103 34/402 |

FOREIGN PATENT DOCUMENTS

| | | | | |
|---|---|---|---|---|
| GB | 606989 | | 8/1948 | |
| WO | WO 00/56460 | A1 | 9/2000 | |
| WO | WO 2012061367 | A1 * | 5/2012 | F26B 17/103 |

OTHER PUBLICATIONS

Written Opinion—PCT/US2011/058759, Nov. 1, 2011, Flash Rockwell Technologies, LLC.

International Preliminary Report on Patentability—PCT/US2011/058759, May 7, 2013, Flash Rockwell Technologies, LLC.

* cited by examiner

METHODS FOR DRYING MATERIALS AND INDUCING CONTROLLED PHASE CHANGES IN SUBSTANCES

REFERENCE TO RELATED APPLICATION

This is a continuation of U.S. patent application Ser. No. 13/285,224 filed on Oct. 31, 2011, which, in turn, claims priority to the filing date of U.S. provisional patent application 61/408,673 filed on 1 Nov. 2010 and to the filing date of U.S. provisional patent application 61/522,922 filed on 12 Aug. 2011.

TECHNICAL FIELD

This disclosure relates generally to methods and devices for transitioning a substance (e.g. water) with a vapor pressure threshold from a first phase (e.g. liquid) to a second phase (e.g. vapor) utilizing induced and controlled pressure conditions, controlled but relatively low temperatures, and controlled pressure drops. The substance may be separated from a material while in its second phase, and then transitioned back to its first phase, where it is now more purified. Further, the material left behind is substantially drier and can be collected for subsequent re-drying or other treatment, use, or discard. Applications include, but are not limited to, systems for separating water from particulate materials such as, for example, coal wash fines to dry the material; systems for desalinization of seawater; systems for making artificial snow; systems for purifying contaminated water; and generally systems for removing a substance with a vapor pressure threshold from other materials. Disclosed are methods and systems that obtain such results without burning fossil fuels to generate heat by using a controlled sub atmospheric pressure environment, controlled but relatively low temperatures, rapid pressure drops, Bernoulli's principle, continuum hypothesis, Pascal's law, Boyles law, and the law of conservation of energy.

BACKGROUND

It is common in many industries that various materials or mixtures of materials require drying at some stage of processing. One example is the drying of (i.e. the removal of water from) coal and coal wash fines in the mining industry. Traditionally, industrial drying has been accomplished through application of heat to bring a moisture laden material to elevated temperatures so that the moisture will evaporate and/or boil away from the material. This approach, however, requires large amounts of energy to produce and apply the heat. This energy is usually derived from the burning of fossil or other fuels, which is not very efficient, is not generally eco-friendly, and in fact is a pollution generator in its own right. At least partially for these reasons, the burning of fossil fuels in the coal mining industry to dry material such as coal wash fines is strictly regulated.

In addition to drying needs, there are industrial needs for transitioning a substance with a vapor pressure threshold from one phase to another phase. Examples include, distilling, mixing, desalinating, recovering oil from oil shale and oil sands, recovering purified distilled water from contaminated water, distilling alcohols from a mash or other mixture, and many others. Desalinization of seawater to produce potable water is one example of a desalinating application. Traditional techniques for desalinizing seawater have tended to require large amounts of externally generated energy in the form of heat, which, again, usually involves the burning of fossil fuels, is exceedingly inefficient, and generally is not eco-friendly. Artificial snow-making also is an industry where the making of artificial snow from water is energy intensive and inefficient, and produces a poor substitute for natural snow. Pond evaporation is another example of an industry that consumes large amounts of energy to produce heat for boiling water or other substances, pollutes the atmosphere, and is generally inefficient. The above examples represent only a few throughout various industries.

A need exists for methods and systems to perform these and many other related industrial tasks more efficiently, using much less energy, requiring the addition of little or no externally generated heat or thermal energy, and in a manner that produces little or no harmful atmospheric emissions and thus is eco-friendly. It is to the provision of such methods and systems that the present disclosure is primarily directed.

SUMMARY

Briefly described, methods and systems are disclosed for carrying out the above and many other industrial processes requiring phase transition of a substance such as water. The disclosed methods and systems perform these tasks vastly more efficiently than traditional techniques and do so in an environmentally responsible manner. Generally, the system may include a sealed hopper for receiving and holding material to be dried or otherwise treated. Internal pressures within the sealed hopper are controlled. A conveyor is configured for receiving material from the sealed hopper and moving it in a downstream direction to be expelled at a discharge end of the conveyor. The material is expelled into at least one venturi barrel within which is arranged one or more, and preferably multiple, venturi exhaust nozzles, or simple venturi nozzles. The venturi nozzles are enclosed within a sealed plenum and the inlets of the venturi nozzles communicate with the plenum.

The plenum, in turn, is coupled to a positive displacement blower or blowers capable of providing low pressure high volume air to the plenum. The air may have an elevated temperature relative to the temperature within the venturi barrel due, for example, to friction and the mechanical operation of the positive displacement blower or blowers. However, this temperature is low relative to the heat required in traditional industrial drying operations and is not generated by burning fossil or other fuels. The low pressure high volume and somewhat heated air enters the plenum and rushes through the venturi nozzles. This generates a vacuum that creates a sub atmospheric pressure within the system that draws material through the system. As the material encounters the venturi nozzle or nozzles within the venturi barrel, it experiences an almost instantaneous and extreme pressure drop due to the venturi effect of the air rushing through the nozzles. This, in conjunction with the elevated temperature of the air feeding the venturi nozzles, causes a target substance (usually water) within the material to flash evaporate instantly, changing phase from a liquid state to a vapor state. The vapor can then be separated from material that remains within the flow using, for instance, a cyclone separator and, after separated, condensed back to its liquid state if desired. Thus, the material flowing through the system is dried without burning fossil fuels. Virtually any degree of drying can be obtained by controlling conditions within the system and/or by passing the material through additional systems for additional drying.

One specific application of the methods and systems of this disclosure is the removal of liquid water from moisture laden coal wash fines in the mining industry. The wet coal wash fines are delivered to a sealed vessel. The material is metered from the sealed vessel to a material conveyor, within which pressure is maintained at sub atmospheric levels due to the suction created by the air rushing through the venturi nozzles. An auger within the conveyor moves the material through a conveyor conduit to be expelled at a discharge end of the conduit into the venturi barrel. As the coal wash fines move through the venturi barrel, they encounter the venturi nozzle or nozzles and the warmer air and rapid extreme pressure drops associated therewith. The low pressure, high speed and warmer air expelled through the venturi nozzles becomes entrained within the flow of coal wash fines and the venturi nozzle or nozzles produce a zone of rapid pressure drop (a pressure drop zone) in the vicinity of the nozzles.

In the pressure drop zone, the pressure to which the flow is exposed drops dramatically, very quickly, and throughout the flow due to known principles of fluid dynamics. This, in conjunction with the decreased density that accompanies the pressure drop and the controlled pressures within the system, causes liquid water in the coal wash fines to flash evaporate virtually instantly from its liquid phase to a vapor phase until optimum flow velocity saturation is obtained. At least a portion of the water is thereby separated from the flow of coal wash fines and, in its vapor phase, can be extracted from the flow by devices designated for this purpose such as, for instance, one or more cyclone separators. The coal wash fines are thus dried as they flow through the venturi barrel. If more drying is required, the flow can be directed through one or more additional venturi barrels and vapor removal devices to remove more moisture from the coal wash fines in the same manner until the desired degree of drying of the fines is obtained.

Due in part to the controlled pressures and extreme pressure drops maintained within the system, the flashing of water within the venturi barrel occurs very efficiently and at low temperatures relative to traditional temperatures required at atmospheric pressures. Thus, the coal wash fines are dried very effectively by flashing liquid water to vapor and extracting the vapor from the remaining flow. Significantly, drying is accomplished without the use of high heat generated by the burning of fossil or other fuels and without the accompanying production of the pollutants and greenhouse gases. The remaining coal wash fines, now dried to the desired moisture content, can be conveyed or transported to a storage building or transported to a cyclone separator for further separation from finer coal dust, and the cyclone exhaust can be directed to a bag house or scrubber for environmental treatment. The flashed-off water vapor also can be collected and re-condensed if desired, or it may be reused as a heated moisturized air supply, or it may simply be exhausted harmlessly to the atmosphere.

In another embodiment, the auger is replaced with a conveyor conduit configured to receive, convey, and discharge substances with a more liquid consistency such as, for instance, a sludge, a slurry, or seawater. Such substances are not suitably conveyed by mechanical means. In this embodiment, the substance is received from the sealed hopper (or atomized and sprayed into the system) and conveyed through the conveyor conduit by an air flow from a low pressure high volume positive displacement blower rather than mechanically as with the auger described above. In the process, the substance becomes highly disbursed within the flow, which enhances the efficiency of flashing to occur downstream at the venturi nozzles. A series of additional venturi nozzles may be disposed along the length of the conveyor conduit to begin to flash and vaporize some of the target substance as it moves through the conveyor conduit.

At the end of the conveyor conduit, the disbursed substance is discharged into a venturi barrel having one or more venturi nozzles disposed therealong as described above. The nozzles are fed by a blower and generate a pressure drop zone in the region of the nozzles. In this zone, the substance is flash vaporized for removal from the flow as described above. If the substance is seawater for example, flash vaporized $H_2O$ can be separated from the flow and condensed into purified potable water for human use. The salts and other minerals left behind can be collected for use or simply discarded harmlessly back to the sea.

Improved methods, systems, and devices are thus disclosed for transitioning a substance with a vapor pressure threshold from one phase (usually a liquid phase) to another phase (usually a vapor phase) with the application of little or no externally generated heat. The examples above are but a few examples of the uses of the methods and systems disclosed herein. They can be used for a wide range of industrial applications in addition to these examples including, without limitation, the drying of coal, coal wash fines, sand, FGD Scrubber material such as calcium sulfate, gilsonite, anthracite, bauxite, bentonite, coke, copper dolomite, floatation concentrates, iron ore, ilmenite, lignite, limestone, lithium, nickel, potash, phosphate rock, rutile, sand, zircon and a broad variety of other materials. Related additional applications include the production of artificial snow, the removal of petroleum from oil shale and oil sands, the separation of oil and water, the purification of contaminated water and other contaminated fluids, and many others. These and other aspects, features, and advantages of the methods and systems disclosed herein will become more apparent to those of skill in the art upon review of the detailed description set forth below taken in conjunction with the accompanying drawing figures, which are briefly described as follows.

DETAILED DESCRIPTION

The flash vaporization phenomenon harnessed in the present disclosure is sensitive to many factors including temperature changes, velocity changes, pressure changes, the duration of pressure changes, relative locations of pressure changes (i.e. placement of venturi nozzles), venturi nozzle configuration, changes in the volume of ambient air admitted to the system, and changes in the flow patterns within the material flow. The ability to manipulate and control these and other factors within the system that characterize the flow environment provides a high degree of control over the flash vaporization phenomenon and thus results in a highly controllable and customizable drying or vaporizing operation in the embodiments disclosed below.

Figure 1:
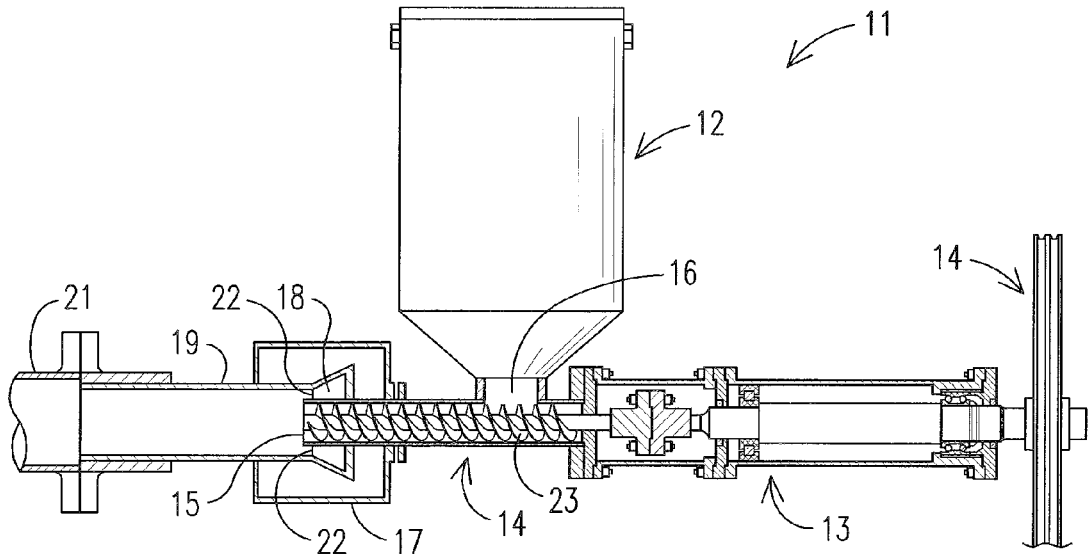
FIG. 1 is a cross sectional view of an apparatus for drying materials according to one embodiment of the invention.

Referring in more detail to the drawing figures, wherein like reference numerals refer, where appropriate, to like parts throughout the several views, FIG. 1 shows one embodiment of an apparatus 11 particularly suited to drying wet or moisture laden material such as, for example, coal wash fines produced during coal mining operations. The apparatus 11 comprises a sealed hopper 12 for receiving and holding the material to be dried. The interior of the sealed hopper 12 can be maintained and controlled at a predetermined pressure, which may be lower than atmospheric pressure of and may be significantly lower such as, for instance, 2 to 5 lbs/in$^2$ (PSI). Under such pressures, the vapor pressure threshold and boiling point of moisture within the material is lowered significantly. For instance, the boiling point of water at atmospheric pressure of 14.7 PSI is 212 degrees Fahrenheit (° F.). However, when pressure is reduced to 4.7 PSI, the boiling point of water becomes 159° F. Exposure of the water to temperatures above 159° F. in a low pressure atmosphere of 4.7 PSI will cause the water to vaporize quickly and change phase from a liquid to a vapor virtually immediately. This phenomenon is sometimes referred to as "flashing."

The moisture laden material can be delivered from the hopper 12 to a material conveyor 14 through a throat 16 communicating with the sealed hopper 12. In this embodiment; the material conveyor 14 comprises a conveyor conduit containing an internally rotatable auger 23 driven through a drive train 13 by a motor (not shown) coupled to a sheave or pulley 14. Pressure within the conveyor conduit likewise is maintained at a predetermined sub atmospheric level due at least in part to the suction created by the downstream venturi nozzle. The rotating auger moves material from the position of the throat 16 in a downstream direction to be expelled from a discharge end 15 of the conveyor conduit. The material is expelled into venturi exhaust barrel 19 at the location of the venture nozzle 22. The venturi nozzle 22 is formed by an inlet 18 and a throat defined by the reduced volume annular space between the discharge end of the conveyor conduit and the interior wall of the venturi exhaust barrel. Thus, the material is expelled from the discharge end of the conveyor approximately at the throat of the venturi nozzle.

A plenum 17 surrounds and sealingly encloses the venturi nozzle and the discharge end of the conveyor conduit. The plenum is coupled to a supply of low pressure high volume gas such as air from an appropriate source such as a positive displacement blower or blowers (not shown). This air enters an air port communicating with the plenum 17 (not visible in FIG. 1) and flows into the inlet 18 of the venturi nozzle. As the air flow traverses the venturi nozzle and reaches the throat 22, it vastly increases in velocity, possibly nearing Mach 1, and increases in temperature, while liberally decreasing in pressure and density. Thus, an extreme pressure drop is established at the location of the throat of the venturi nozzle. At the same time, the local temperature of the air in the region of this pressure drop can be tens of degrees up to about a hundred degrees above the temperature of the material flow. This is due at least in part to the natural heating of the air processed through the positive displacement blower and to friction generated by air rushing through the venturi nozzle. Externally generated heat is not introduced in this embodiment.

The high speed flow of higher temperature air through the venturi nozzle draws material through the venturi barrel and becomes entrained in the material flow thereby raising its temperature. At the same time, the extreme pressure drop caused by the venturi effect of the venturi nozzle permeates the material flow dropping pressure almost instantaneously throughout the flow. These factors lower instantaneously the temperature threshold required to change the phase of or vaporize moisture within the material flow as the material moves through the venturi exhaust barrel. As a result, moisture within the material virtually instantly flash evaporates from a liquid phase to a vapor phase. As the phase transition occurs, latent heat either stored or released has not proven to be a notable factor since the environment within the system is carefully controlled at thresholds well below the triple point phase transition curve.

The vaporized moisture can be collected by well known methods and exhausted, condensed, or otherwise captured for further use. The now dryer material from which the moisture has been removed is expelled through a discharge pipe to be collected, stored, further dried, or further processed as needed. It will thus be seen that the methods and systems of this disclosure can be applied to remove moisture from and dry wet material such as moisture laden coal wash fines effectively, quickly, and at a cost that is far less than the cost of prior art thermal methods of drying the material. The methods and systems of the present disclosure are exceedingly eco-friendly in that no fossil fuels are burned to produce external heat and no harmful exhausts or greenhouse gasses are created to pollute the atmosphere.

Figure 2:
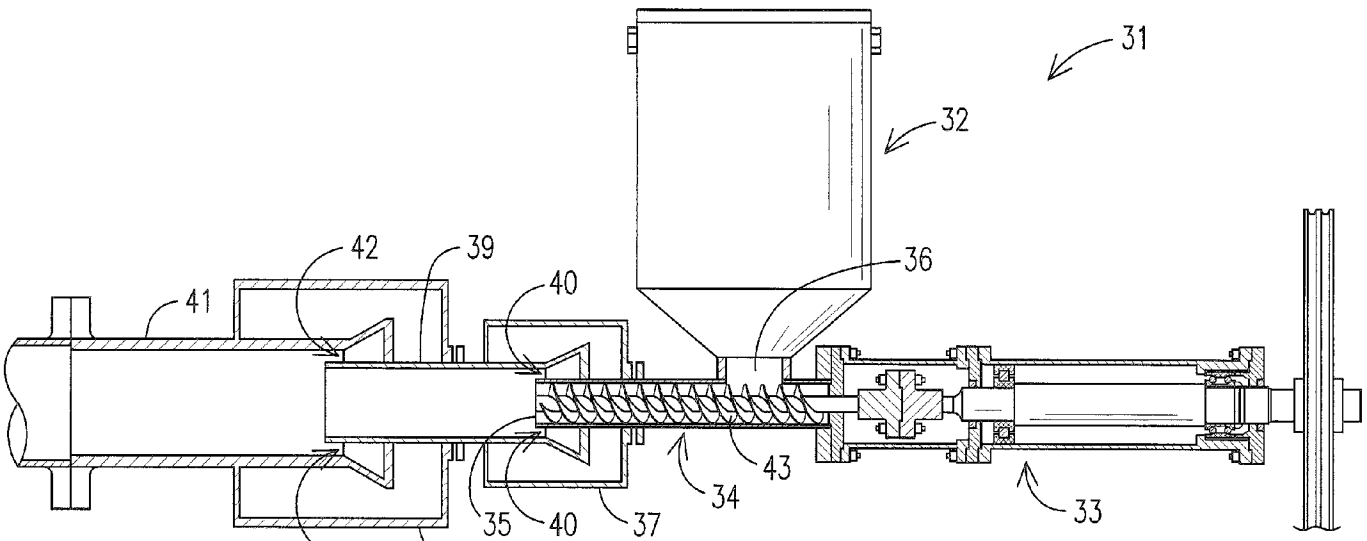
FIG. 2 is a cross sectional view of an apparatus for drying materials according to another embodiment of the invention.

FIG. 2 shows the basic system of FIG. 1, but with a dual stage venturi for flashing moisture from material twice before it leaves the system. In this embodiment, the material is expelled from the discharge end 35 of a conveyor conduit 34 at the throat of a venturi nozzle 40 as described above, where the moisture is flashed off and the material semi dried. The material then moves through the first venturi exhaust barrel 39 and exits at the throat 42 of a second venturi nozzle within a separate plenum 38, coupled to an appropriate blower. The same flash vaporization phenomenon occurs again here as described above and the material is dried even further before it is expelled through the second venturi exhaust barrel 41, from where it can be directed to collection, separation, or further treatment.

Figure 3:
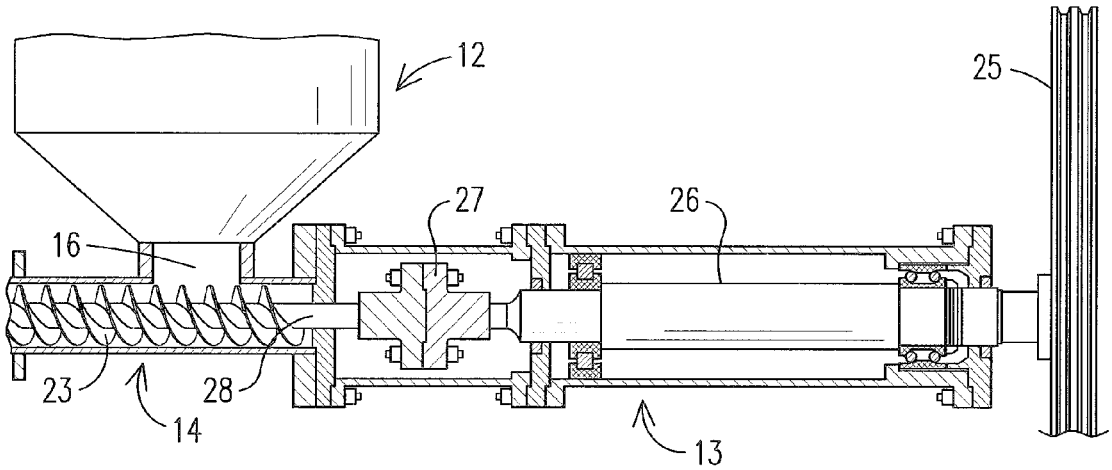
FIG. 3 is an enlarged cross sectional view of the drive train of the apparatus of FIGS. 1 and 2 showing a portion of the auger and the conveyor conduit.

FIG. 3 is a close-up view of one possible configuration of a drive train 13 for rotating the auger 23 in this particular embodiment. The auger shaft 28 is connected through a coupler 27 to a drive shaft 26 that, in turn, is driven by a pulley or sheave 25 coupled to a motor (not shown). Activation of the motor causes the auger to rotate within the conveyor conduit, thus transporting material to be dried toward the venturi sections of the apparatus as described above. Many other drive trains and configurations may be utilized with equivalent results, and all are encompassed by the invention.

Figure 5:
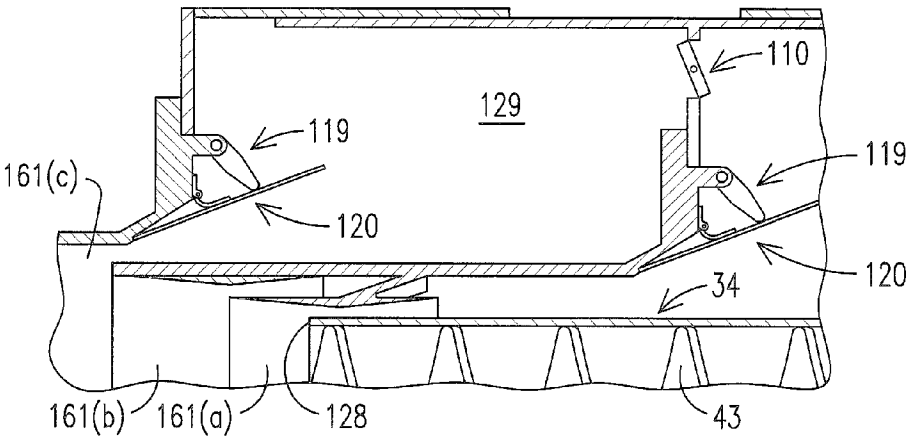
FIG. 5 is an enlarged cross sectional view showing the end of the conveyor conduit with internal auger and depicting the multiple venturi nozzles encountered by material as it is expelled from the discharge end of the conveyor conduit.
Figure 4:
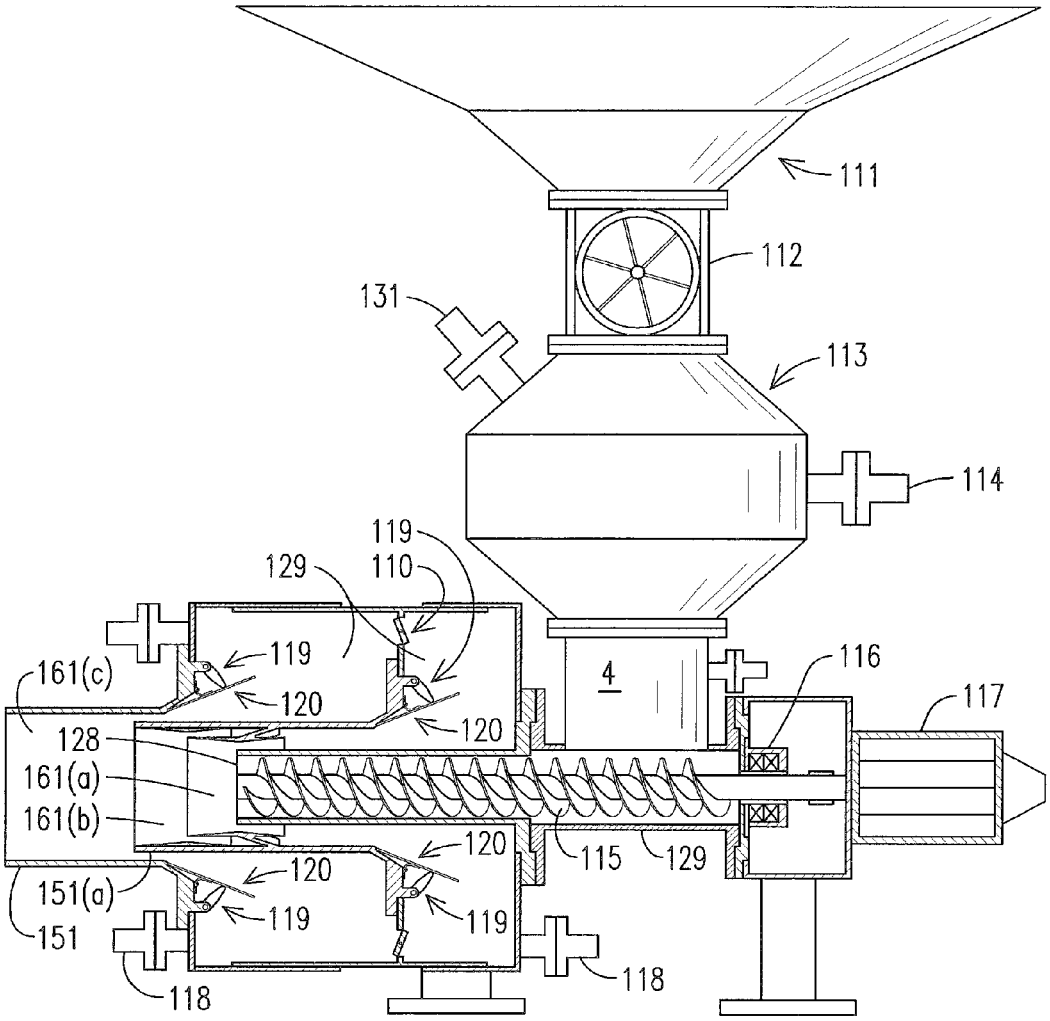
FIG. 4 is a cross sectional view of an apparatus for drying materials according to a third embodiment of the invention.

FIGS. 4 and 5 illustrate an alternate embodiment of an apparatus for drying material according to the invention. This embodiment is configured with multiple and nested venturi nozzles for even more efficient drying by flash vaporizing moisture within multiple zones within the system. A material feed 111 communicates with a sealable feeder valve 112 and with the sealed hopper 113. The pressure within the sealed hopper 113 is established and controlled through vacuum control ports 131 and 114 so that the pressure within the sealed hopper can be established and maintained at, for example, less that atmospheric pressure. The sealed hopper also may contain de-lumping, discontinuity, or agitating devices to prevent the material from clumping together, thereby promoting more effective drying of the material as it moves through the system. The material is delivered through a feed chamber 4 (which also may contain de-lumping or agitating devices) into the material conveyor conduit 129. In this embodiment, a rotatable auger moves the material toward and expels it from the discharge end 128 of the conveyor conduit 129.

A set of three nested venturi nozzles are located just downstream of the discharge end 128 and the material experiences a pressure drop and higher temperatures as it moves through the pressure drop zone created by the venturi nozzles. This virtually instantaneous pressure drop and temperature increase flash vaporizes some of the moisture within the material. By the time the material is expelled from the most downstream venturi nozzle, it is very dry and ready for subsequent collection, storage, cleaning, or use.

With more specific reference to FIG. 4, a plenum 129 seals and encloses the venturi nozzles and the discharge end 128 of the conveyor conduit 129. The plenum 128 is coupled to a blower or blowers, which supply high volume low pressure air to the plenum to feed the venturi nozzles. The plenum in this embodiment is internally divided into two sub chambers, one feeding air to the inner venturi nozzles and the other feeding air to the outer venturi nozzles. Relative air pressure within the sub-chambers can be controlled by adjustable valves 110 and each venturi nozzle preferably is configured with adjustable intakes controlled by intake air angle nozzle adjustment mechanisms 119. This provides a measure of control over the conditions within the throats of each venturi nozzle by controlling air flow through the nozzle, and thus provides more control of the drying process.

FIG. 5 is an exploded cross sectional view of the nested venturi nozzle section of the system of FIG. 4. The discharge end 128 of the conveyor conduit is located at the throat portion of a first venturi nozzle 161(*a*) and the exit or exhaust end of the first venturi nozzle is located at the throat of a second venturi nozzle 161(*b*). Finally, the exhaust end of the second venturi nozzle 161(*b*) is located at the throat of a third venturi nozzle 161(*c*), which exhausts into a venturi exhaust barrel for delivering dried material downstream. As mentioned above, the intakes for the first two venturi nozzles 161(*a*) and 161(*b*) are controllable through adjustable intake assemblies 120 controlled by intake nozzle adjustment mechanisms 119. These are all shown simply in the figures for clarity, but may in reality be as complex as necessary to perform their assigned tasks.

Again, as the material leaves the end 128 of the conveyor conduit, it is entrained within and merges with the high velocity low pressure air flowing through the venturi nozzles. The material thus instantly encounters an extreme pressure drop as it moves through the pressure drop zone created by the venturi nozzles. This, in turn, lowers the temperature required for phase transition of a target substance such as water in the flow. At the same time, the temperature within the flow is raised by the higher temperature airflow exiting the nozzles. Under these conditions, the temperature of the material may be several tens of degrees higher than the local phase transition temperature. Flash evaporation of the moisture thus occurs virtually instantaneously as the material moves through the pressure drop zone. The material is thus dried as moisture is flash evaporated to vapor. The longer pressure drop zone created by the multiple venturi nozzles increases the duration time the material is subjected to flashing conditions. Thus, the material is dried to a greater degree than with a system such as that of FIG. 1 with a single venturi nozzle creating a narrow pressure drop zone. The process is very effective and efficient. The vaporized moisture can be separated from the dried material, collected, reclaimed and condensed to a purified liquid phase, simply exhausted to atmosphere, or used as a moisturized heated air supply if desired.

Figure 6:
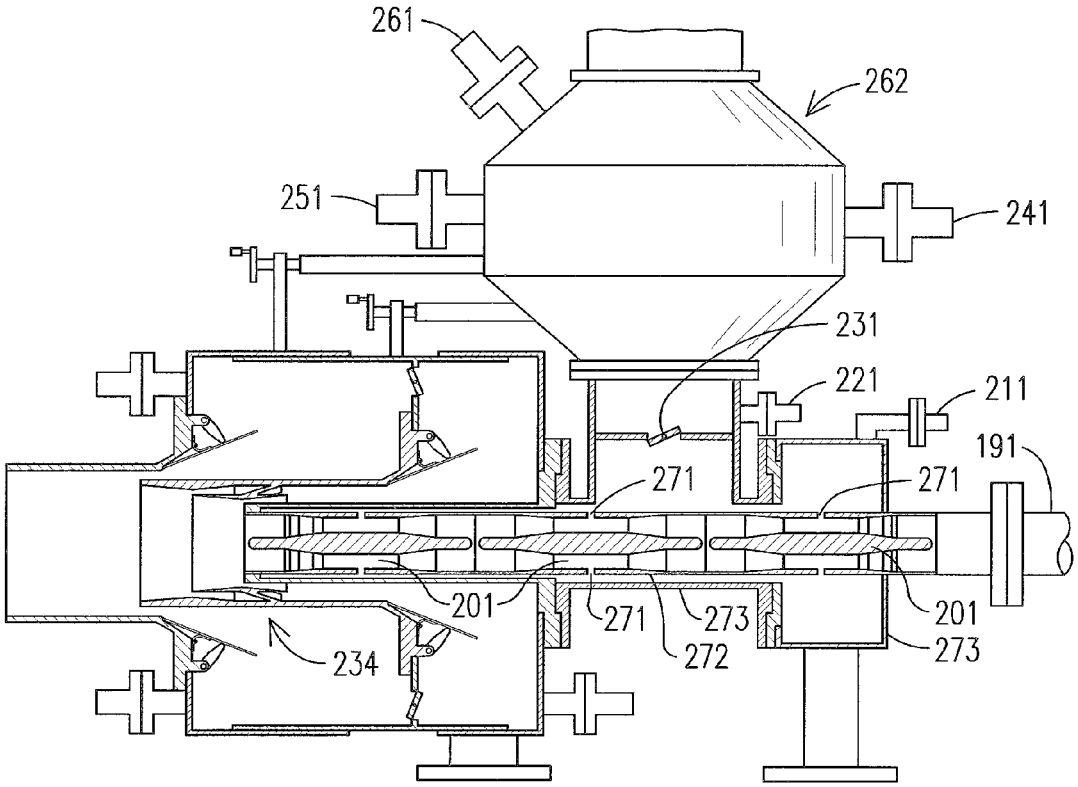
FIG. 6 is a cross sectional view of an apparatus for drying material according to yet another embodiment of the invention.

FIG. 6 illustrates an alternate embodiment of a system particularly useful for processes such as drying a more liquid consistency material; flash drying a slurry of water and particulates; flash evaporation of water in a stream of seawater for desalinization; or the making of artificial snow. In this embodiment, the downstream nested venturi nozzles are arranged in the same configuration as in FIG. 5. However, the material conveyor of this embodiment does not utilize a mechanical auger. Rather, material is conveyed through the conveyor conduit 272 and to the venturi exhaust barrel with a stream of high velocity low pressure air provided by a positive displacement blower (not shown) coupled to air feed port 191. One or more flow diverters 201 are arranged within the conveyor conduit and each defines a venturi throat between the outer surface of the flow diverter and the inner surface of the conveyor conduit 272. At the venturi throats, the pressure of the high speed air is reduced through the venturi effect, velocity increases, and the temperature is increased due to friction and compression and as a result of being processed through the positive displacement blower.

The conveyor conduit 272 is sealed and enclosed within a plenum 273, which is maintained at a desired pressure, which may be sub atmospheric, and receives a controlled amount of material to be processed from a pressure controlled vessel 262. As the high velocity air moves through the conveyor conduit 272 and through the venturi throats defined therein, material is drawn into control flow intake ports 271 formed in the conveyor conduit at the locations of the venturi throats. Other ports can be formed in the conveyor conduit 272 if desired for processing a particular material. As the material enters the conveyor conduit through the inlet ports 271, the material immediately encounters the pressure drops and elevated temperatures at the venturi throats and the target substance in the material (water for example) immediately flash evaporates at least to some degree. In the illustrated embodiment, there are three flow diverters 201, three venturi throats, and three intake ports along the conveyor conduit. Other numbers and arrangements are possible, however, and within the scope of the invention. With such a configuration, the target substance (water) therein is partially vaporized before being expelled and flashed multiple additional times at the venturi nozzle arrangement generally indicated at 234 and described in detail above. Higher efficiencies may thereby be realized.

Figure 7:
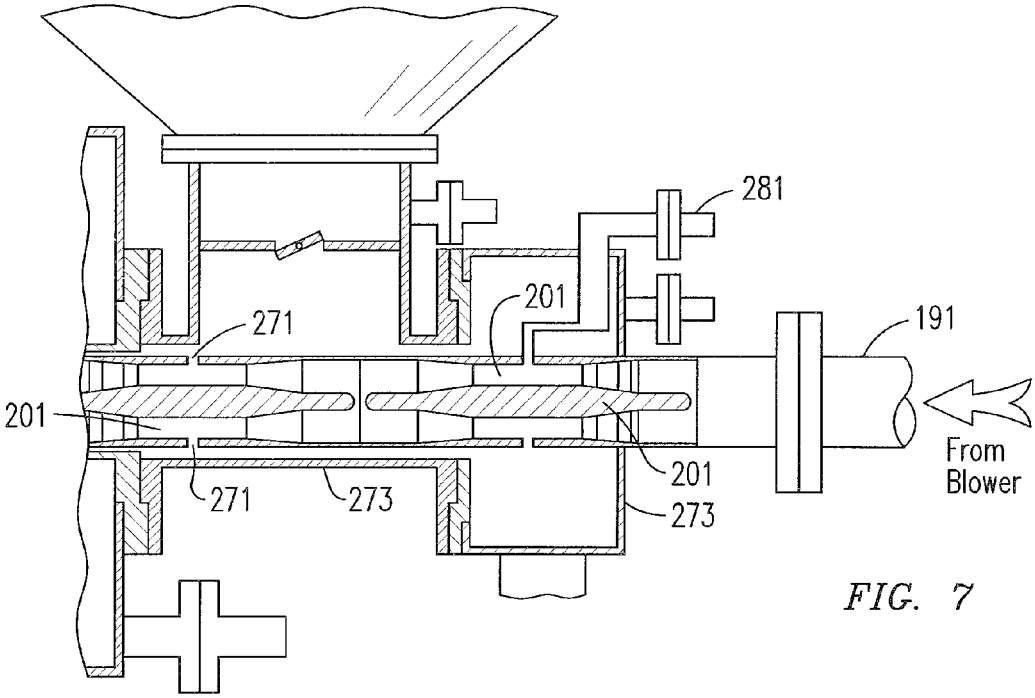
FIG. 7 is an enlarged cross sectional view illustrating the conveyor conduit with internal venturi nozzles of the embodiment of FIG. 6.

FIG. 7 is an enlarged view of a portion of the conveyor conduit 272 with its internal flow diverters defining venturi throats 201 as described above and shows more clearly the inlets at the throats of the venturi nozzles. In addition, FIG. 7 shows port 281 connected directly to one of the inlet ports 271. The port 281 can be used to introduce additives to the flow, to introduce heat into the flow to control temperatures, to admit controlled amounts of ambient air, or for other purposes.

As an example, the material to be processed in an embodiment such as that of FIG. 6 might be seawater, wherein the target substance to be vaporized is $H_2O$. As the $H_2O$ is flash vaporized from the flow of seawater at the multitude of venturi nozzles, the salts, minerals, and other materials are left behind. The water vapor resulting from the flashing can then be collected and condensed into purified potable water. This process is far more efficient than traditional desalinization methodologies wherein massive amounts of heat energy are input to boil seawater and distill potable water from the resulting vapor, or large amounts of energy are used in a traditional reverse osmosis process.

The embodiment of FIG. 6 also is useful for any process where a target substance in a material needs to be flashed vaporized rapidly for collection or use. Examples include, without limitation, the making of artificial snow, wherein flashed water vapor is exhausted into cold atmospheric pressure causing it to condense rapidly and crystallize into snowflakes. In snow making, dust or other particles can be added to the vapor through port 281 or trough ports at other locations to create seeds around which water vapor can condense and crystalize. This mimics the manner in which natural snow is formed in the atmosphere and thus results in more natural crystal snowflakes as opposed to the ice particles that can be created with traditional snow making machinery. Many other applications such as those enumerated above are possible.

Figure 8:
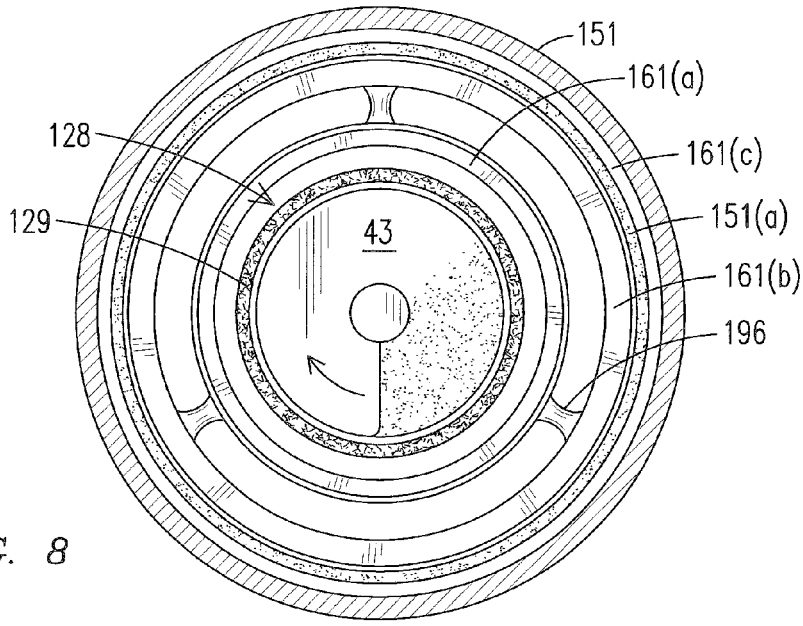
FIG. 8 is a cross sectional view taken along A-A of FIG. 4 showing the relationships of the ducts and the venturi nozzles disposed therein.

FIG. 8 is an end view of the inner nested venturi nozzles 161(*a*), 161(*b*), and 161(*c*) of FIGS. 4, 5, and 6 to illustrate better one possible configuration of these nozzles. FIG. 8 depicts the augur of the embodiments of FIGS. 4 and 5, but also applies to the embodiment of FIG. 6 without the auger. As shown, rotating auger 43 is disposed within conveyor conduit 129 having discharge end 128. Material exits the conveyor conduit at the throat of a first venturi nozzle 161(*a*) concentrically supported by a set of support spokes 196. Beyond the first venturi nozzle 161(*a*), the material enters the second venturi nozzle 161(*b*) and from there is ejected at the throat of the third venturi nozzle 161(*c*). The three venturi nozzles generate a pressure drop zone throughout the extent of the nozzles wherein an extreme pressure drop is encountered by material moving through the system. While three venturi nozzles are illustrated in this embodiment, it will be understood by the skilled artisan that fewer or more can be used to produce a desired drying effect for a particular application, as illustrated in embodiments described below.

Figure 9:
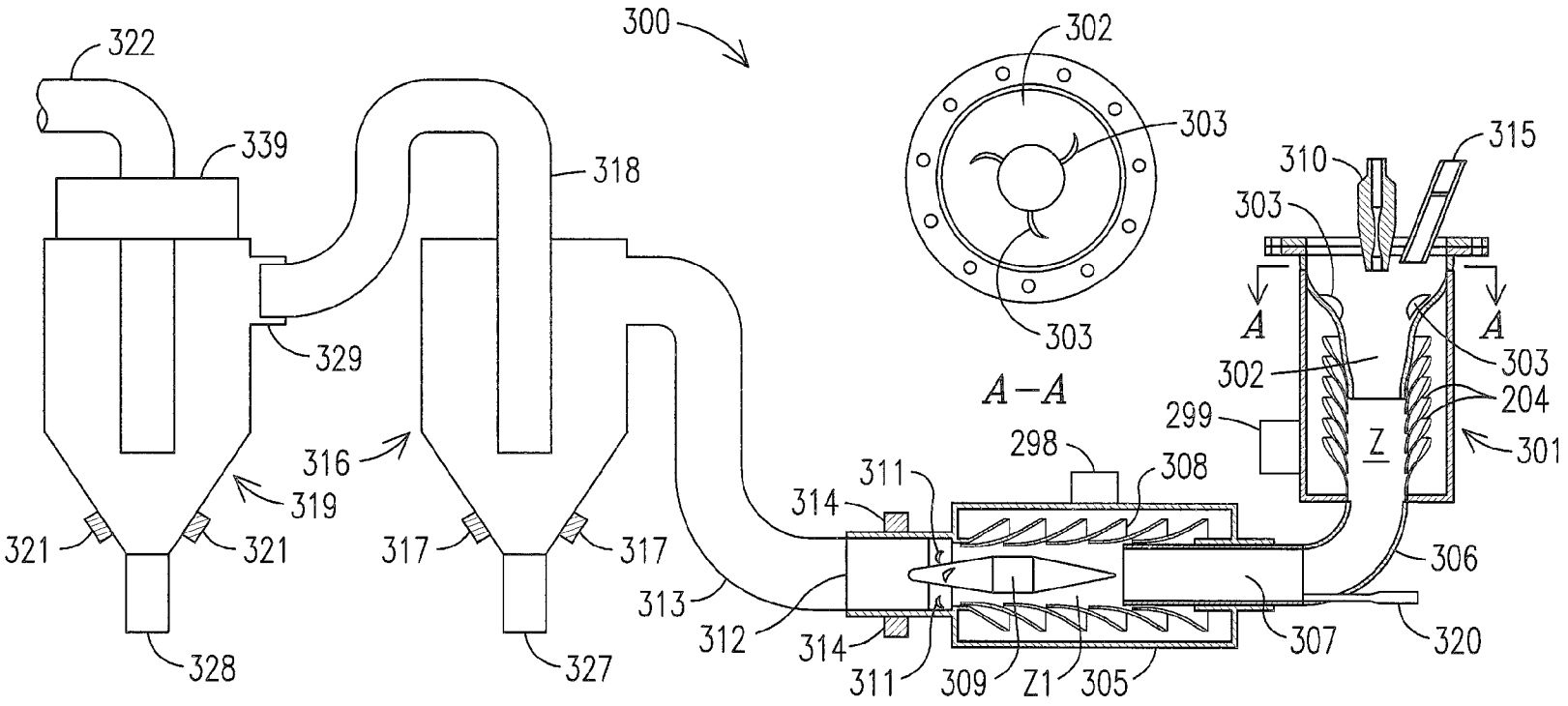
FIG. 9 is a schematic illustration of a system that embodies principles of the invention in another form for use with liquids and materials of a more liquid consistency.

FIG. 9 illustrates an embodiment of a system for manipulating phase changes in virtually any target substance that has a vapor pressure threshold. The system of FIG. 9 is particularly useful when processing liquids or materials with a more liquid consistency such as, for example, drying of liquids containing particulate matter; distillation of a target substance from a compound (e.g. distillation of ethanol); mixing substances to form a multiple mixture compound; purification of contaminated water to recover clean distilled water; and desalination of seawater to recover potable water. When extracting water for human consumption, vitamins, minerals, or other beneficial ingredients can be added in the process. This system also can be used to supplement already recovered or otherwise distilled water or other substances by adding minerals, vitamins; and/or other additives.

Referring in more detail to FIG. 9, the system 300 comprises a plenum 301 having an air coupling 299 coupled to a positive displacement blower or blowers (not shown). The blower supplies high volume low pressure air to the plenum and establishes a pressure in the plenum, which may be a few PSI above local ambient pressure. An inlet chamber 302 and conduit 306 extend through the plenum 301 and the plenum is capped with a sealed cover plate as shown. An atomizing nozzle 310 is affixed to the sealed cover plate and is configured to deliver material to be treated into the inlet chamber 302 in an atomized or otherwise highly disbursed condition. A heat control valve 315 communicates through the sealed cover with the inlet chamber 302 and can be used to control the temperature in the inlet chamber by allowing predetermined amounts of temperature controlled ambient air into the process stream. A plurality of venturi nozzles are arranged in series within the plenum 301 and together create a pressure drop zone Z that is encountered by the material as it passes beyond the inlet chamber 302. The inlet chamber 302 thus serves as a reduced pressure chamber, as well as a structure for guiding material into the pressure drop zone Z. The pressure drop zone Z is characterized by a continuous extreme low pressure throughout its extend created by the nested venturi nozzles. Pressures within the pressure drop zone Z can be 10 PSI or more below local atmospheric pressure.

When the material encounters pressure drop zone Z, the pressure drops extremely and rapidly below the vapor pressure of the target substance and at least a portion of the substance is flash vaporized and at least partially separated from the material stream. For example, if the material is seawater, the seawater is atomized or otherwise disbursed into the inlet chamber. Then part of the $H_2O$ (the target substance) within the seawater is flash vaporized as the seawater traverses pressure drop zone Z. The vapor becomes separated from but entrained within the atomized seawater stream and moves with the stream through the system. For materials such as oil shale for example containing a target substance such as oil that has higher vapor pressures than water, heat may be introduced in a controlled manner through the heat control valve 315 to establish the necessary conditions for flash vaporization of the oil within pressure drop zone Z.

From the pressure drop zone Z, the disbursed material stream with some entrained vapor is directed through conduit 306 to inlet 307 of a second series of venturi nozzles 308 that create a second pressure drop zone Z1. A siphon 320 communicates with the inlet 307 in the illustrated embodiment and can be used to introduce additives or other substances, or ambient air or heat to the material stream. For example, when desalinating seawater, the flashed water vapor within the material stream is essentially distilled water with no beneficial minerals. If the water is for human consumption, minerals, vitamins, and other nutrients can be added through the siphon 320 (or other similar ports) to mix with the water vapor. When the vapor is later condensed into liquid water, the water contains the essential nutrients and minerals desired in water for human consumption.

As the material stream exits the inlet 307, it encounters pressure drop zone Z1 created by the series venturi nozzles 308. This further flash vaporizes the target substance, water for instance, in the material stream. Conditions can be controlled via pressure, temperature, and the quantity and placement of the venturi nozzles such that as much or as little of the target substance is vaporized as is desired. The remaining material in the stream can thus be rendered as dry or as moist as needed and the vaporized target substance removed.

A flow diverter 309 may be placed within the material stream if desired to divert the stream toward the inside surfaces of at least some of the venturi nozzles, and thereby increase the velocity of, and reduce the pressure within the material stream. In this way, the material is exposed to a more extreme pressure drop and duration at the discharge of the pressure drop zone Z1. The flow diverter can be supported by a set of support vanes 311, which can be aligned with the flow or can be angled to induce a vortex within the flow if desired. A vortex may begin the separation of vapor from the remaining heavier material in the material stream or be beneficial for other purposes.

After traversing the second pressure drop zone Z1, the material stream with entrained vapor passes through an outlet port 312. Magnets 314, which can be permanent magnets or electromagnets, may be disposed around the outlet port (or elsewhere for that matter) to induce a magnetic field within the outlet port that permeates the material stream. This can be advantageous when the target substance vaporized from the material stream is diamagnetic. Water vapor, for example, is a diamagnetic substance. In these cases, the magnetic field slows or retards the vaporized substance entrained in the flow stream relative to the remaining material from which it has been removed. This, in turn, helps prevent the vaporized substance from recombining with the material from which it has been removed as it moves further downstream through the system 300. In addition, a magnetic field can be similarly induced in the metal of the nozzles. Such a magnetic field repels slightly the material stream from the surfaces of the nozzles creating a barrier and thereby reducing greatly the tendency of the material to collect or cake onto nozzle surfaces, particularly at the throats of the nozzles.

The stream moves from the outlet 312 through conduit 313 to a first cyclone separator 316, which functions in a conventional way to separate the lighter vaporized substance from the heavier material from which the substance has been removed through vaporization. The stream swirls about the interior of the separator and the heavier material is forced to the outside walls while the lighter vapor remains in the central portion of the separator. The material drops to the bottom of the separator and through the outlet from where it can be collected. The vaporized substance exits the cyclone separator through centrally located exhaust 318. When used for drying a slurry containing coal fines, for instance, the dried coal fines are collected from the outlet of the cyclone separator while the removed water vapor exits through the exhaust 318. Magnets 317 can be placed at the neck of the cyclone separator 316 or elsewhere if desired to inhibit the recombination of any remaining traces of the vaporized target substance with the material from which it has been removed.

In the embodiment of FIG. 9, the recovered vaporized target substance recovered in the cyclone separator 316 is directed to a second cyclone separator 319, which may be provided with an auxiliary fan or blower. This second cyclone separator further separates remaining finer material from the vaporized substance as described. The auxiliary fan may induce a higher rotational speed within the second cyclone separator and throughout the complete system to enhance separation, flashing, pressure drops, and to increase the recovery of finer and lighter dried material from the material stream. An additive port 329 may be disposed to communicate with any cyclone separator in a system for supplying additives to the vaporized substance, such as minerals to water vapor during a desalination application. A venturi nozzle also may be disposed at the inlet of any cyclone separator to provide another pressure drop zone as needed.

From the second cyclone separator, the vaporized target substance, now separated from other substances in the original material, is delivered through conduit 322 to a remote location for collection, discard, condensation, or further processing. For example, in a desalination operation, the recovered water vapor may be delivered to a condenser unit for condensing the water vapor to purified essentially distilled liquid water, which may contain minerals or other additives supplied through the siphon 320 and/or other additive ports of the system.

The pressure drops, air volume, temperature, and degree of disbursement of any material, substance, or mixture can be carefully controlled by manual controls and/or automatic controls as required to maintain internal conditions at optimum values for the flashing of a target substance within a material stream. Sensors can be located at strategic locations within the system for delivering various data to a computer or PLC (Programmable Logic Controller), which may be programmed to adjust system controls automatically to maintain optimum conditions within the system for flash vaporization of a particular target substance. Different substances that may be targeted for vaporization from a material stream likely have different vapor pressure thresholds and different properties so that a dynamic control system controlled by a computer or PLC is considered desirable for a commercial system.

Figure 10:
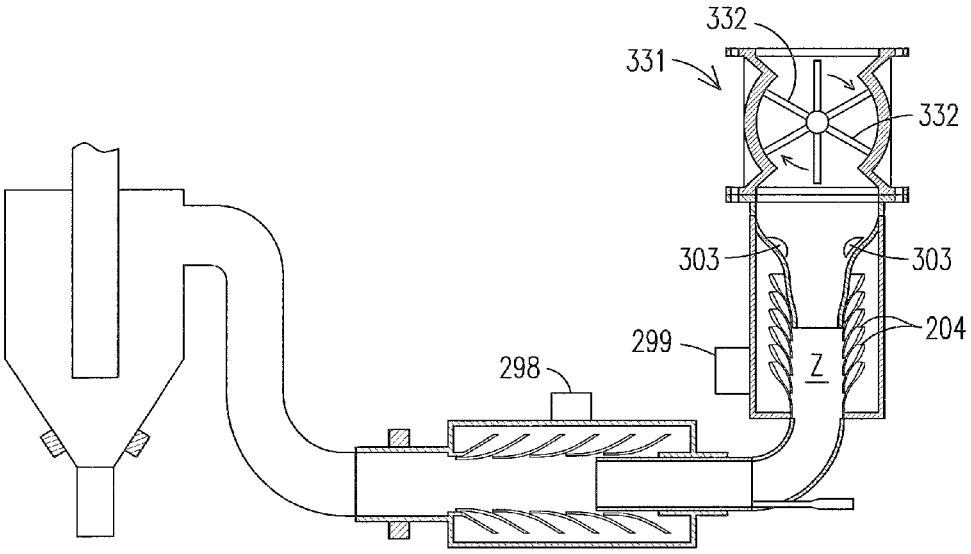
FIG. 10 is a schematic illustration of a system that embodies principles of the invention in yet another form for use with slurries or other similar consistency materials.

FIG. 10 illustrates an alternate variation of the system of FIG. 9 for use in vaporizing a substance from a stream of a more solid material such as, for instance, removing water from a paste of coal wash fines to dry the coal wash fines and separate the dried fines from the slurry. For such applications, an atomizer nozzle is not suitable for delivering the slurry to the inlet chamber 302 of the vessel 301. Instead, an air lock rotary valve 331, which may have rotating vanes 332, may be used to meter the slurry to the inlet chamber 202 of the system while maintaining the sealed condition of the chamber. Various agitators or other devices also may be used at this point to disburse the material better as it enters the system. The more the material is disbursed, the more surface area is presented and the better will be the vaporization of a target substance from the material stream. Vanes 303 may be employed to induce a vortex in the material stream to disburse it further and help ensure that material flows toward the outside of the pressure drop zone Z where pressure drops can be most dramatic.

Figure 11:
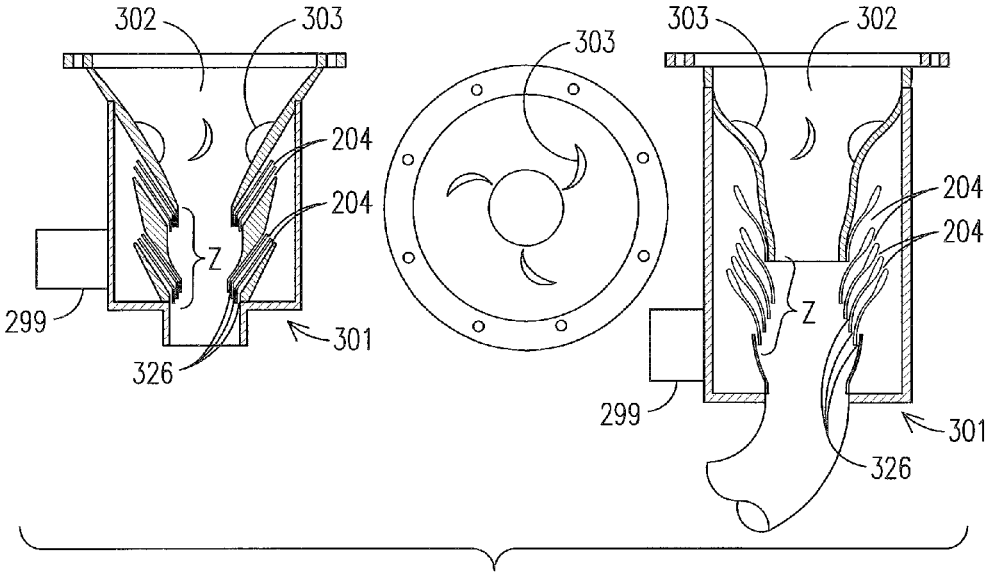
FIG. 11 is an enlarged cross sectional view showing two possible configurations of the inlet vaporization vessel of the embodiment of FIG. 9.

FIG. 11 is an enlarged cross sectional view illustrating possible configurations of the pressure chamber 301 for the embodiment of FIG. 9 illustrating better possible configurations of the nested venturi nozzles for creating the pressure drop zone Z. In these variations, the venturi nozzles on the right are curved in configuration and each has an inlet port 204 and a throat 326. The venturi nozzles of the variation on the left are substantially straight or frustroconical in configuration with each nozzle also having an inlet port 204 and a throat 326. Pressure drops are generated at the throats 326 of each venturi nozzle and these pressure drops establish pressure drop zone Z throughout which extremely low pressures are maintained. The pressure drop, in conjunction with the increased temperature of the venturi air stream, causes a target substance, such as water, in the material stream to flash evaporate to vapor at least partially as it moves through the pressure drop zone Z. Curved or angled vanes 303 can be affixed to the walls of the inlet chamber 302 if desired to induce turbulence or a swirling motion or vortex in the material stream as it moves through the inlet chamber 302. Such a motion is believed to enhance the flashing process by diverting material through centrifugal force toward the inner surfaces of the venturi nozzles where pressure drops can be more pronounced.

Figure 12:
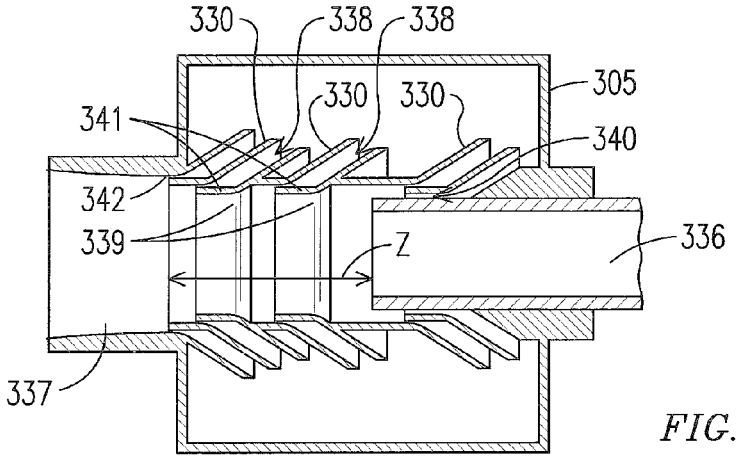
FIG. 12 is an enlarged cross sectional view showing one embodiment of a venturi nozzle arrangement with multiple straight venturi nozzles.
Figure 13:
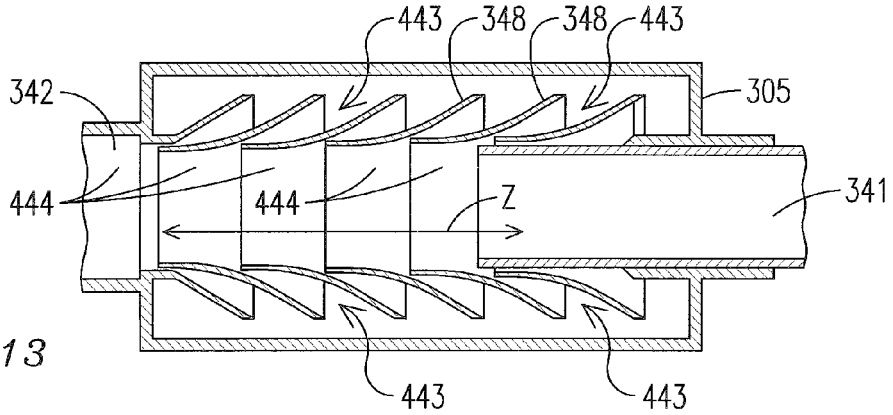
FIG. 13 is an enlarged cross sectional view showing another embodiment of a venturi nozzle arrangement with multiple curved venturi nozzles.

FIGS. 12 and 13 illustrate alternate embodiments of nested venturi nozzles sealed within a plenum 305 for inducing flash vaporization. In the embodiment of FIG. 12, the venturi nozzles have inlet ports 338 formed by substantially frustroconical baffles 330 with portions of the nozzles downstream of their throats 339 being substantially cylindrical as indicated at 341. In the embodiment of FIG. 13, curved and nested venturi nozzles are shown having inlet ports 443 defined between smoothly curved baffles 348 that taper inwardly to define throats 444 of the venturi nozzles. In each embodiment, axial flows 340, mixed flows 341, and rotating or vortex flows 342, can be induced in the material stream dependent on material properties and parameters required to flash or change the phase of a target substance. Any of these configurations of venturi nozzles, as well as many others, may be selected and used by those of skill in the art so long as the requisite pressure drops are generated by the nozzles. All nozzle configurations are contemplated and included within the scope of the present invention.

Figure 14:
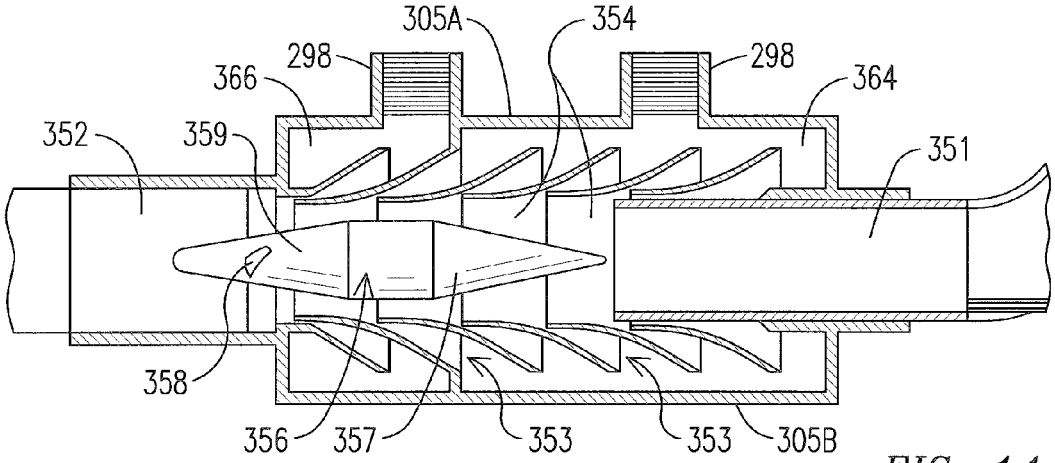
FIG. 14 is a cross sectional view of an embodiment of a venturi nozzle arrangement with curved inlet ports and an internal flow diverter.

FIG. 14 illustrates yet another embodiment and perhaps shows better the flow diverter disposed within the material flow. In this embodiment, the plenums 305A, 305B define an upstream plenum 364 and a downstream plenum 366. A respective air supply port 298 communicates with each plenum and each is coupled to a source of high volume low pressure air such as a positive displacement blower. In this way, environmental conditions (e.g. pressure and temperature) can be controlled to be different in the upstream plenum than in the downstream plenum. A flow diverter 356 is disposed within the flow and is held in place with support vanes 358, which may be curved as shown to induce a rotating vortex within the flow if desired. They also may be straight where no vortex is desired. As the material stream passes from the port 351 through the low pressure zone established by the venturi nozzles, the material is diverted by the flow diverter 356 toward the throats of the nozzles. More specifically, the stream is first compressed outwardly as it traverses the upstream end of the flow diverter, where its velocity is increased and its pressure decreased. The stream then traverses the cylindrical mid portion of the flow diverter and is most confined, has the lowest pressure, and has the highest velocity in this region. This has two effects. First, the material is forced to move through the more intense pressure drops that occur nearer the venturi nozzles. Second, the flow diverter itself acts as a venturi inducing a further pressure drop thereby aiding the vaporization process within the system.

Figure 15:
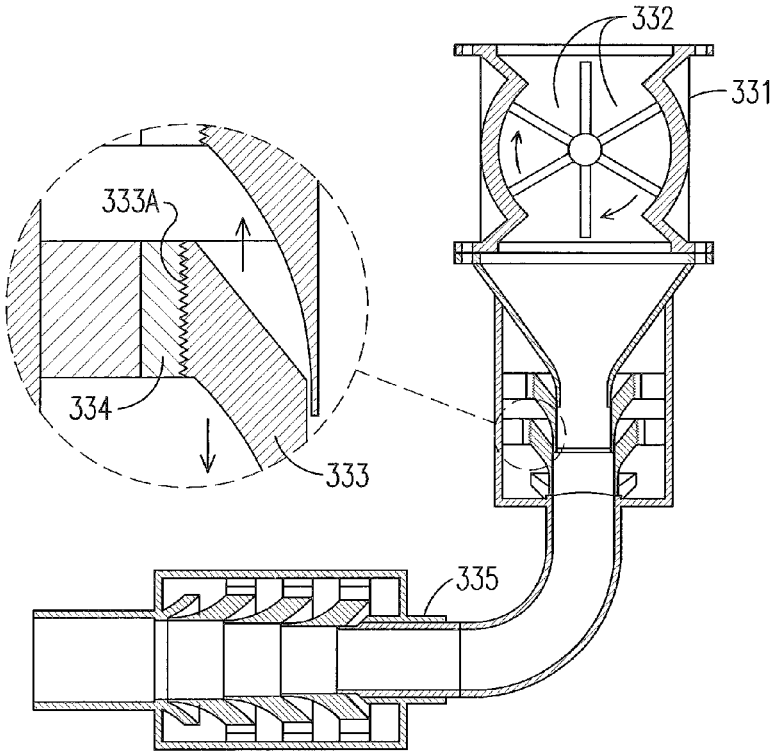
FIG. 15 is a cross sectional view of one embodiment of a system of this invention having adjustable venturi nozzles.
Figure 15A:
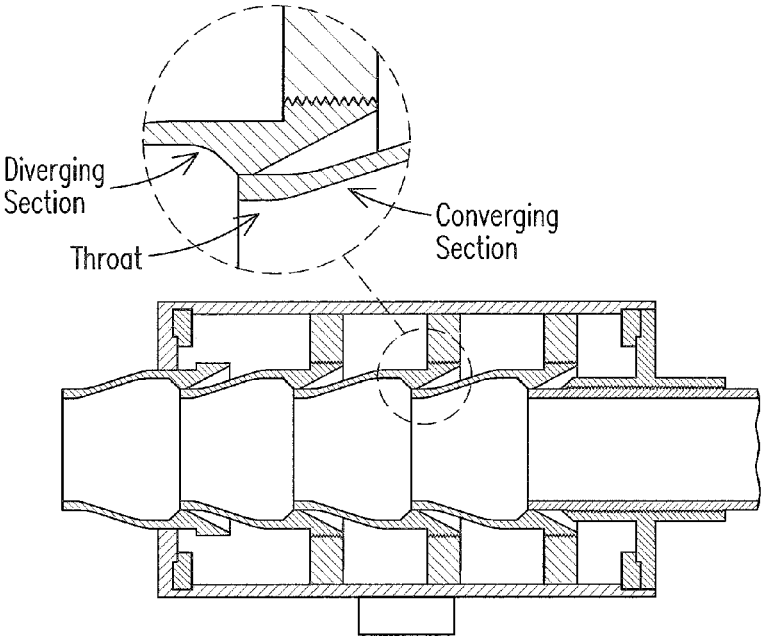
FIG. 15*a* is a cross sectional view of another embodiment of a venturi nozzle configuration where the nozzles are adjustable and define converging-diverging nozzles that accommodate supersonic flows.

FIGS. 15 and 15A illustrates another embodiment of a venturi nozzle arrangement that has adjustable venturi nozzles 333. More specifically, each venturi nozzle 333 has a threaded rim 333A that is threadably received within a threaded ring 334 fixed to the walls of a plenum. Each venturi nozzle can thus be rotated to move it in the downstream direction or the upstream direction. In use, the venturi nozzles are adjusted as necessary depending upon the properties of the target substance and the material stream to control the amount of engagement of the venturi nozzle. This, in turn, permits fine adjustments in pressure drop and friction generated heat created by each nozzle. The nozzles are adjustable independent of each other and thus can be adjusted individually to create different pressure and temperature gradients along the length of the nestled nozzle arrangement thereby creating a pressure drop zone with varying properties along its length.

The port 335 through which material is fed to the nested venturi nozzles adjusts in the upstream or downstream direction similarly to the venturi nozzles themselves. Adjustments can be made to induce changes in the pressure and air friction creating more or less pressure reduction and more or less temperature within the material stream. The metering valve 331 limits the amount of ambient air flow drawn into the system, thus increasing drying and or controlling the results of the drying process. This valve also controls the amount and rate at which material is introduced to the system. The system is controllable to create a continuous sub atmospheric pressure environment, which can be carefully controlled and optimized for a target substance by introducing heat where necessary, controlling pressure drops, controlling temperature increases, selecting appropriate venturi nozzle designs, and proper monitoring and adjustment of the system in general.

FIG. 15A also embodies an illustrates an alternate nozzle design in the form of a de Laval type "converging-diverging" venturi nozzle that effectively allows the use of supersonic air flow thru the nozzles without producing a choked flow. Such a design and supersonic flow may be used when very extreme pressure drops and higher temperatures are required to flash a target material. As can be seen in the inset image, the converging section is formed by the upstream end of one nozzle, which converges to a throat at its most constricted point. The upstream end of the next successive venturi nozzle flares outward to form the diverging portion of the converging-diverging design of the nozzle array. The use of a supersonic material stream allowed by such a nozzle stream enhances greatly the flash evaporation and phase change of very high concentrations of moisture and may result in up to one hundred percent of a liquid such as water being flashed to vapor in uses such as seawater desalinization. It also may be useful for target substances having significantly higher vapor pressure thresholds such as oil, for example.

Figure 16:
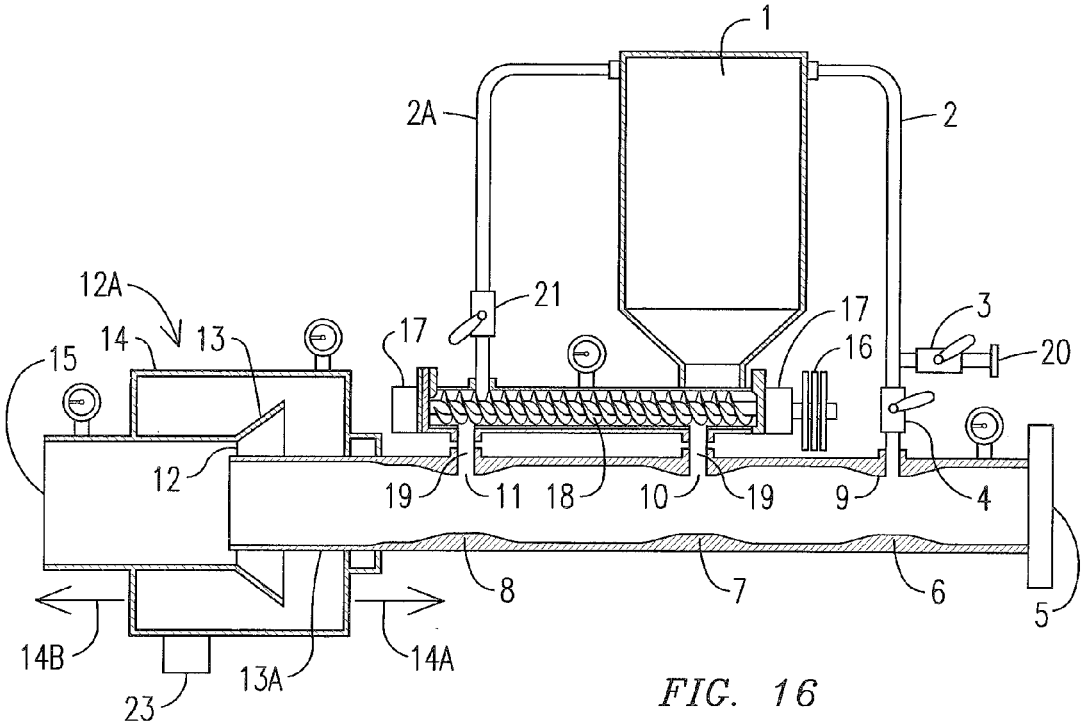
FIG. 16 is a cross sectional view of yet another embodiment of a system that embodies principles of the invention.
Figure 16A:
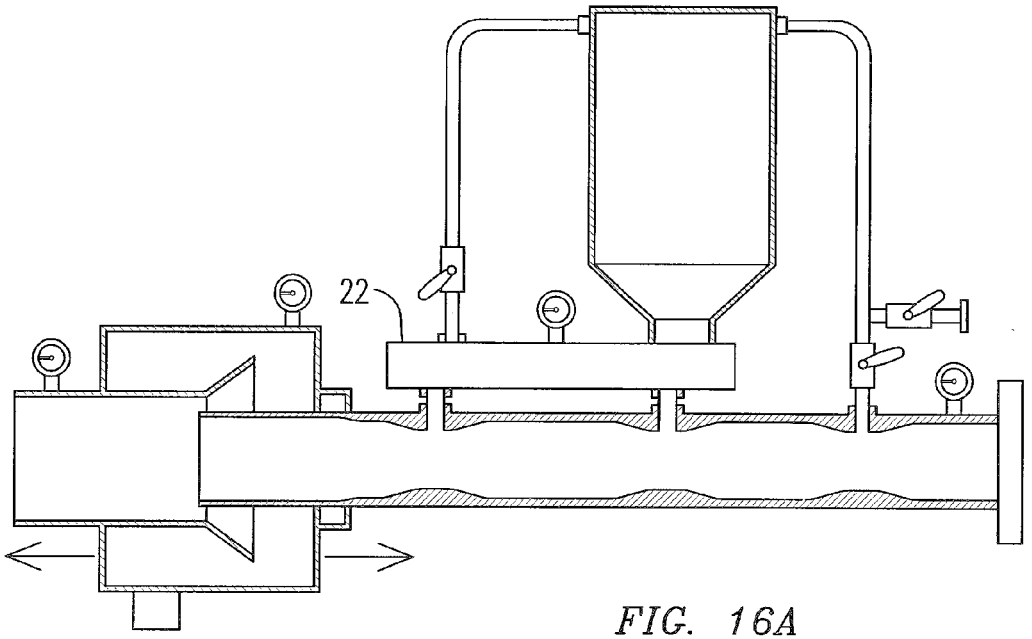
FIG. 16*a* is a cross sectional view of still another embodiment of a system that embodies principles of the invention.

FIGS. 16 and 16A, embody and illustrate another embodiment of an apparatus for drying material according to the present invention. FIG. 16 shows this embodiment of the apparatus with an auger (for material having a less liquid more solid consistency) while FIG. 16A shows the apparatus without an auger (for liquids and material having a more liquid consistency). The sealed vessel 1 holds and distributes the material to be processed as low pressure high volume air enters the intake port 5 from a blower (not shown). The primary venturi 9 generates a pressure drop and a reduced pressure line 2 communicates with the primary venturi 9. A valve 4 just above the primary venturi 9 regulates the amount of pressure drop from the primary venturi that is coupled to the sealed vessel 1. Valve 3 regulates the amount of ambient air pressure and ambient air temperature allowed through inlet 20 and into the sealed vessel 1. Valve 21 adjusts the balance of pressure from the sealed vessel to a tertiary venturi nozzle 11. The valve 21 can be adjusted to equalize pressure or keep the pressure un-equalized as required for the best feed of material into the system.

The auger 18 is driven by a pulley or sheave 16 driven in turn by a motor (not shown). A direct drive or other drive arrangement also may be used to turn the auger. The auger supplies material through ports to the throat of secondary venturi nozzle 10 and to the throat of the tertiary venturi nozzle 11 within the conveyor conduit. A preliminary phase transition thus occurs within the conveyor conduit as material is conveyed downstream toward the main venturi nozzle assembly 12A. As described above, the main venturi nozzle assembly 12A includes a plenum 14 that encloses and seals a venturi nozzle 12 fed through a venturi inlet port 13. In this embodiment, the plenum is slidable in the directions indicated by arrows 14A and 14B on the end 13A of the conveyor conduit. In this way, the engagement of the venturi nozzle 12 can be changed as needed simply by sliding the plenum one way or the other on the conveyor conduit. This allows for pressure and temperature adjustment of the final venturi nozzle 12 as air enters the frustroconical converging inlet port 13.

A low pressure high volume air supply is coupled through port 23 to the sliding plenum 14 as detailed above to feed the venturi nozzle and thus to produce a phase transition as material traverses the pressure drop zone created by the nozzle. The phase transition is completed and material with entrained vapor is discharged from discharge conduit 15 for final separation, collection, or further processing. FIG. 16A illustrates the same system as FIG. 16 but without an auger, and this system may be more appropriate for flashing liquids such as seawater and materials with a more liquid consistency.

In view of the exemplary embodiments described above and illustrated in the accompanying drawings, it will be understood by the skilled artisan that the environment and conditions within the systems can be established and controlled in numerous ways depending upon the desired result. More specifically, pressure, temperature, and flow gradients can be evenly distributed, sporadically distributed, an/or a combination thereof. Venturi ports and nozzles can be sporadically spaced, evenly spaced, or otherwise configured with respect to one another to obtain a desired pattern of pressure drops and pressure drop zones. Venturi ports and nozzles can be concentrically arranged or eccentrically arranged in order to control flow patterns, pressures, and temperature gradients encountered by material and substances moving through the system. Flow patterns, pressures, pressure drops, temperatures, and other parameters can be established based upon desired results, individual media properties, reactions of material and substances to the process processes, or other criteria. All venturi ports, venturi nozzles, flow patterns, siphon ports, and other components of the systems disclosed herein can be statically established, or dynamically controlled to optimize a drying or phase change control in real time if desired. All of these possibilities and other exist and are contemplated by the inventors and included within the scope of the inventions presented herein.

Examples

Tests were conducted to confirm the efficacy of the above described methods and systems for drying of common industrial materials that historically have been dried with energy derived from the burning of fossil or other fuels or merely discarded. The materials tested were moisture laden coal wash fines, Gilsonite, sand, and FGD Scrubber material, specifically calcium sulfate and calcium sulfite. In addition to demonstrating that these materials can be effectively and efficiently dried applying the methods and systems of this invention; desalination was demonstrated by removing purified $H_2O$ from salt water taken from the Great Salt Lake in Utah.

The tests were conducted with two systems similar to that shown in FIG. 9. Test System 1 had a single pressure drop zone similar to that shown at 301 in FIG. 9 and Test System 2 had two sequential pressure drop zones similar to those illustrated in FIG. 10. The positive displacement blowers used with the test systems were Gardner Denver Sutorbilt blowers available from Gardner Denver, Inc. of Wayne, Pa. The blowers were coupled to the inlet 299 in System 1 and to inlets 298 and 299 in System 2 to supply a constant airflow to the plenums. Pressure within the plenums during the tests was measured at about 5 PSI above local atmospheric pressure (i.e. around 20 PSI). Pressure within the pressure drop zones was measured at about 10 PSI below atmospheric pressure (i.e. around 4 to 5 PSI) as a result of the venturi effect created by the venturi nozzles. Theoretically, it is believed that this pressure drop can be as much as about 14 PSI below local atmospheric pressure. Pressures within the material flow at other locations were not measured in these tests, but it is believed that they are maintained at a sub atmospheric level primarily by the suction generated by the air flows through the venturi nozzles.

Test materials to be dried in the drying tests were introduced through airlock 331 and salt water in the desalinization test was atomized into the inlet chamber 302 by means of an atomizing nozzle 310. In the case of materials to be dried, the total moisture within the material both before being dried and after being dried was determined by ASTM standard D3302 entitled Standard Test Method for Total Moisture in Coal. The results of these tests are presented in the graphs of FIGS. 17-23.

Figure 17:
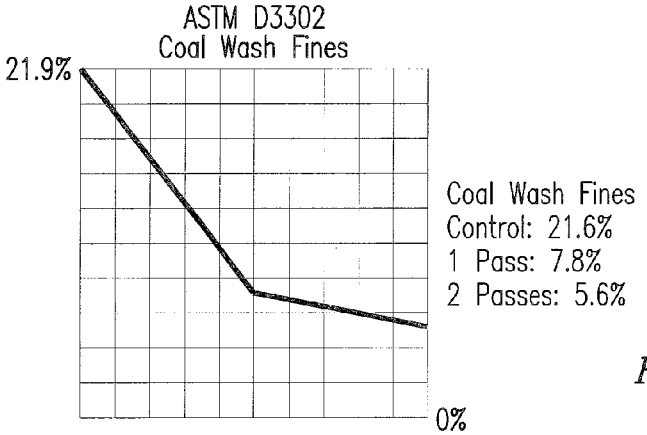
FIGS. 17-23 are graphs presenting the results of various tests conducted to demonstrate the drying of materials according to the methods of the invention.
Figure 18:
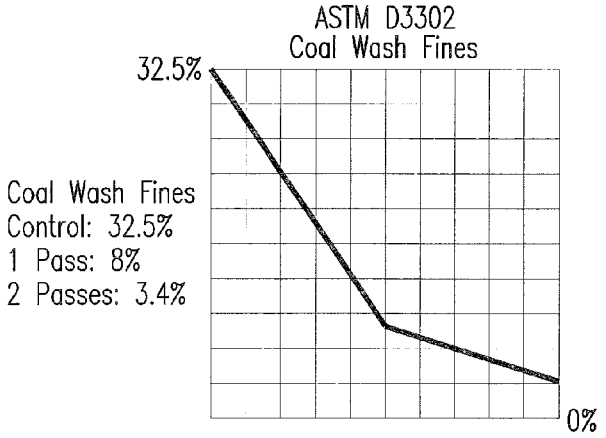

FIGS. 17 and 18 demonstrate the results for two different samples of coal wash fines using Test System 1 with a single pressure drop zone. In the test of FIG. 17, the moisture in the test sample before drying was determined using the ASTM standard to be 21.9%. The sample was passed through Test System 1 two times, and total moisture was determined after each pass. After the first pass, the measured total moisture was 7.8% and after the second pass, the measured total moisture was 5.6%. In the test of FIG. 18, the initial moisture content of the sample of coal wash fines was measured to be 32.5%. After the first pass through the Test System 1, measured total moisture was 8% and after the second pass, measured moisture was 3.4%. These represent a substantial reduction in total moisture content of the test samples of coal wash fines, which was obtained without the addition of externally generated heat.

Figure 19:
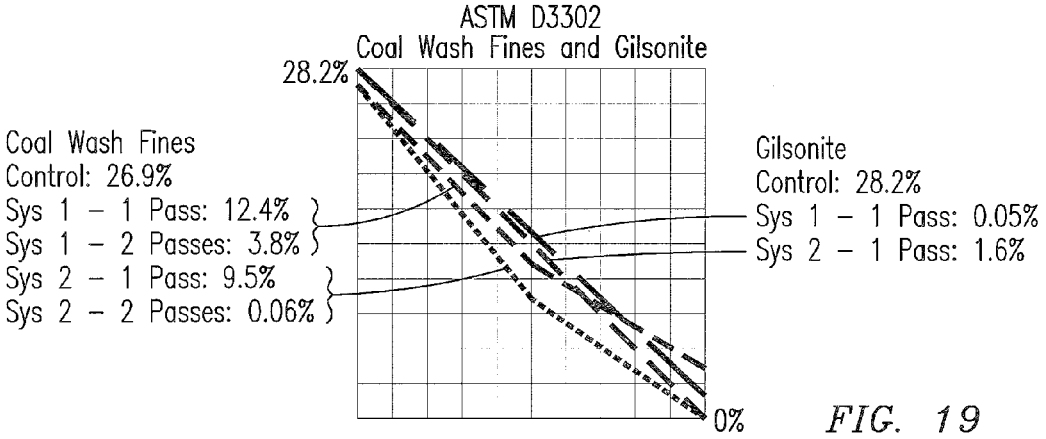

FIG. 19 presents the results of four different tests; two for coal wash fines and two for moisture laden Gilsonite. The test sample of coal wash fines was dried using Test System 1 and Test System 2 and the samples were passed through each system twice. The test sample of Gilsonite was dried using Test Systems 1 and 2 and was passed through each system once. As can be seen from FIG. 19, the total moisture in the sample of coal wash fines before drying was determined to be 26.9%. After the first pass through Test System 1, the total moisture was reduced to 12.4% and after the second pass to 3.8%. Using Test System 2, total moisture was reduced to 9.5% after the first pass and to 0.06%, virtually completely dry, after the second pass. For the test sample of Gilsonite, one pass through Test System 1 reduced the total moisture in the sample from 28.2% to 0.05% and one pass through Test System 2 reduced total moisture to 1.6%. It can thus be seen that the systems and methods of this invention can result in an extraordinary level of drying. Further, it is believed that virtually any level of drying can be achieved by appropriately controlling the conditions within the system.

Figure 20:
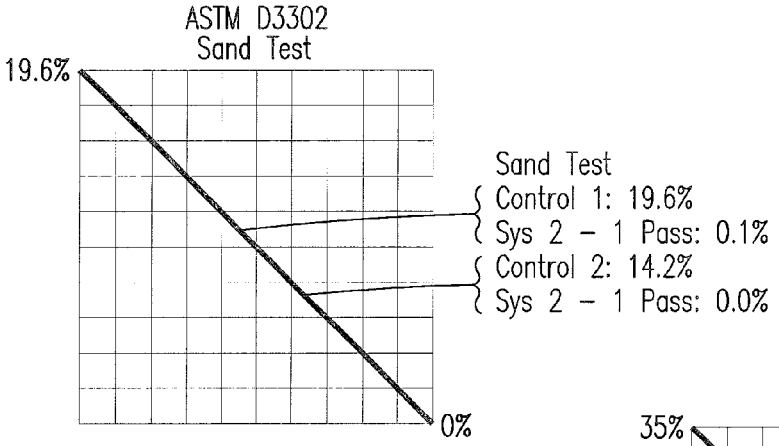

FIG. 20 illustrates the test results for the drying of two test samples of moisture laden sand. The samples were each passed a single time through Test System 2. The total moisture in the first test sample was reduced from 19.6% to 0.1% and the total moisture in the second test sample was reduced from 14.2% to a level of virtually 0.0% (i.e. un-measurable using the ASTM standard). The systems and methods of this invention are thus exceedingly efficient at drying sands.

Figure 21:
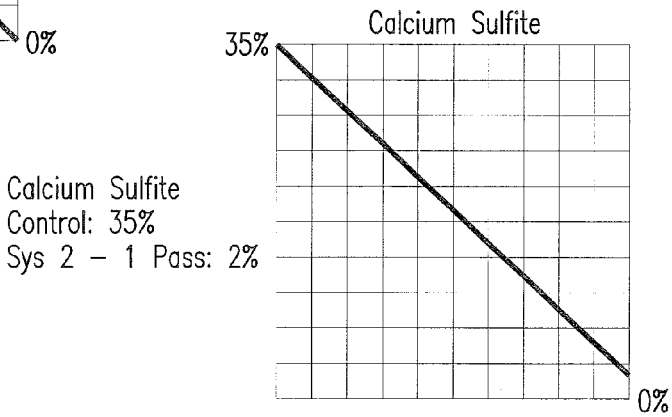
Figure 22:
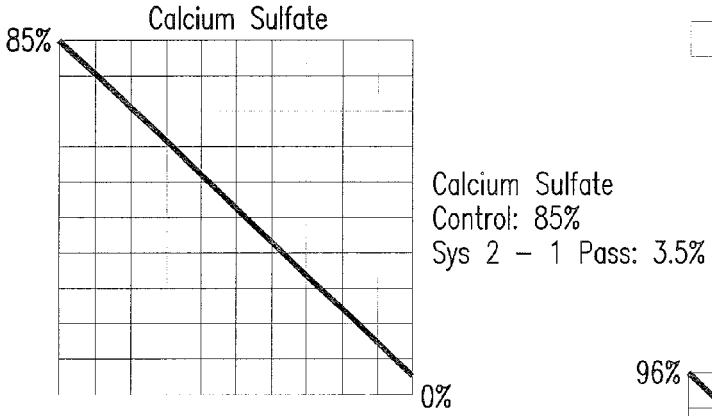

FIGS. 21 and 22 represent the results of drying tests for moisture laden calcium sulfite and calcium sulfate, both FDG scrubber materials, using Test System 2 with a single pass through the system. Calcium sulfite (FIG. 21) was dried from an initial total moisture content of 35% to a powder consistency with only 2% total moisture. Calcium sulfate (FIG. 22) was dried from a high total moisture content of 85% to a powder consistency with only 3.5% total moisture.

Figure 23:
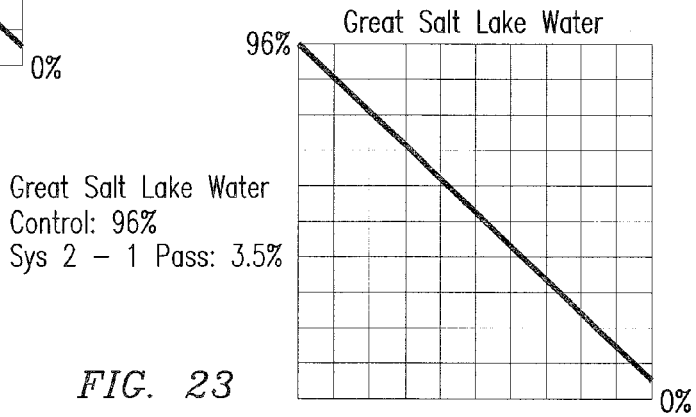

Finally, FIG. 23 illustrates the test results for the desalinization test. A sample of salt water was taken from the Great Salt Lake in Utah and passed through Test System 2 once. The total $H_2O$ content of the sample before being passed through the system was measured to be 96%. After one pass through Test System 2, 92.5% of the $H_2O$ was converted to vapor and separated from the salts, minerals, and other components of the test sample of salt water. While not a part of this test, the vaporized $H_2O$ can be collected as described hereinabove and condensed back to distilled liquid water using known condensation techniques. Thus, it is demonstrated that the systems and methods of this invention can be used for recovering potable water from seawater effectively and efficiently and without auxiliary heat sources.

The systems and methods of this invention have been described herein in terms of preferred embodiments and methodologies considered by the inventor to represent the best mode of carrying out the invention. It will be clear to those of skill in the art, however, that a wide variety of additions, deletions, and modifications both subtle and gross might well be made to the illustrated embodiments without departing from the spirit and scope of the invention.

What is claimed is:

1. A method of transitioning a target substance having a vapor pressure threshold from a liquid phase to a vapor phase, the method comprising the steps of:

(a) establishing a predetermined pressure environment that extends from an upstream location to a downstream location, the predetermined pressure within the environment being greater than the vapor pressure threshold of the target substance;

(b) establishing at least one pressure drop zone within the predetermined pressure environment, the pressure within the pressure drop zone being less than the vapor pressure threshold of the target substance;

(c) establishing a flow of the target substance through the predetermined pressure environment toward the downstream location;

(d) moving the flow of the target substance through the pressure drop zone within the predetermined pressure environment to cause at least a portion of the target substance to flash evaporate from a liquid state to a vapor state; and (e) removing the vapor from the flow.

2. The method of claim 1 wherein the target substance comprises water.

3. The method of claim 1 wherein the target substance is a component within a material comprising other components wherein step (c) comprises establishing a flow of the material containing the target substance toward the downstream location.

4. The method of claim 3 wherein the other components comprise components of seawater.

5. The method of claim 3 wherein the other components comprise solids.

6. The method of claim 5 wherein the solids comprise particulate material.

7. The method of claim 6 wherein the particulate material comprises coal wash fines.

8. The method of claim 1 where in step (a) the predetermined pressure is a sub atmospheric pressure.

9. The method of claim 1 and further comprising the step of establishing at the pressure drop zone a temperature that is higher than the temperature within the predetermined pressure environment.

10. The method of claim 1 wherein step (b) comprises arranging at least one venturi nozzle in the path of the flow and supplying the at least one venturi nozzle with an air stream sufficient to establish the pressure within the pressure drop zone.

11. The method of claim 10 wherein the at least one venturi nozzle comprises plurality of venturi nozzles.

12. The method of claim 11 wherein the venturi nozzles are arranged in series along the path of the flow.

13. The method of claim 10 wherein the step of supplying the at least one venturi nozzle with an air stream comprises enclosing the at least one venturi nozzle with a plenum and supplying the plenum with an air stream.

14. The method of claim 1 wherein step (e) comprises passing the flow through at least one cyclone separator.

15. A method of removing a target substance having a vapor pressure threshold from a material, the method comprising the steps of:

(a) establishing a flow of material through a first environment having a first pressure and a first temperature, the first pressure being greater than the vapor pressure threshold of the target substance within the first environment;

(b) moving the flow of material through a second environment having a second pressure and a second temperature, the second pressure being lower than the vapor pressure threshold of the target substance within the second environment;

(c) as a result of step (b), vaporizing at least a portion of the target substance within the material, the resulting vapor becoming entrained within flow of material; and (d) separating the vapor from the flow of material.

16. The method of claim 15 wherein the target substance is in a liquid phase prior to step (b).

17. The method of claim 16 and further comprising the step following step (d) of condensing the separated vapor back to a liquid phase.

18. The method of claim 17 wherein the target substance comprises water.

19. The method of claim 18 wherein the material comprises seawater.

20. The method of claim 18 wherein the material comprises at least one solid.

21. The method of claim 20 wherein the at least one solid comprises a particulate.

22. The method of claim 21 wherein the particulate comprises coal wash fines.

23. A method of drying moisture laden coal wash fines comprising the steps of:

(a) establishing an atmosphere having a first temperature and a first pressure greater than the vapor pressure threshold of water at the first temperature;

(b) establishing a pressure drop at a predetermined location within the established atmosphere, the predetermined location having a second temperature greater than the first temperature and the pressure within the pressure drop being less than the vapor pressure threshold of water at the second temperature;

(c) moving the coal wash fines from the established atmosphere through the pressure drop to cause at least some of the water within the coal wash fines to flash evaporate to water vapor thereby at least partially drying the coal wash fines;

(d) moving the coal wash fines and the water vapor to a separator;

(e) separating with the separator the vapor from the coal wash fines; and (f) collecting the at least partially dried coal wash fines.

24. The method of claim 23 wherein step (b) comprises establishing at least one venturi at the predetermined location.

25. The method of claim 23 wherein step (b) comprises establishing two or more venturis in series with each other.

26. The method of claim 25 wherein the two or more venturis are nested.

* * * * *